US011679852B1

(12) United States Patent
Pritchard

(10) Patent No.: US 11,679,852 B1
(45) Date of Patent: Jun. 20, 2023

(54) SUPERVENTILATED BLADE THAT PROVIDES HYDRODYNAMIC FORCE IN A LIQUID AT HIGH SPEED

(71) Applicant: Shaun Anthony Pritchard, Eastsound, WA (US)

(72) Inventor: Shaun Anthony Pritchard, Eastsound, WA (US)

( * ) Notice: Subject to any disclaimer, the term of this patent is extended or adjusted under 35 U.S.C. 154(b) by 61 days.

(21) Appl. No.: 17/147,473

(22) Filed: Jan. 13, 2021

Related U.S. Application Data

(63) Continuation-in-part of application No. 15/303,203, filed as application No. PCT/US2015/024215 on Apr. 3, 2015, now Pat. No. 10,926,837.

(60) Provisional application No. 62/049,867, filed on Sep. 12, 2014, provisional application No. 61/977,024, filed on Apr. 8, 2014.

(51) Int. Cl.

| | |
|---|---|
| ***E04B 1/18*** | (2006.01) |
| ***B63H 1/18*** | (2006.01) |
| ***B63H 1/20*** | (2006.01) |
| ***B63H 1/26*** | (2006.01) |

(52) U.S. Cl.
CPC ..... *B63H 1/18* (2013.01); *B63H 1/20* (2013.01); *B63H 1/26* (2013.01)

(58) Field of Classification Search
CPC ..... B63B 1/248; B63B 1/288; B63B 2745/00; B63B 2746/00; B63B 1/24; B63B 1/28; B63B 1/30; B64C 25/32; B63H 1/18; B63H 1/26; B63H 20/26; B63H 2001/185; B63H 1/20
USPC ..... 114/39.15, 29.24, 55.54, 274, 278–282
See application file for complete search history.

(56) References Cited

U.S. PATENT DOCUMENTS

| | | | | |
|---|---|---|---|---|
| 2,274,200 A * | 2/1942 | Hill | B63B 1/248 | 114/274 |
| 2,309,953 A * | 2/1943 | Harrison | H01H 1/08 | 335/162 |
| 3,077,173 A * | 2/1963 | Lang | B63B 1/38 | 440/49 |
| 3,099,239 A * | 7/1963 | Hanns | B63B 1/30 | 114/282 |
| 3,213,818 A * | 10/1965 | Barkley | B63B 1/24 | 114/280 |
| 3,221,698 A * | 12/1965 | Turner | B63B 1/288 | 114/278 |
| 3,788,267 A * | 1/1974 | Strong | B63H 1/18 | 440/89 R |
| 4,975,023 A * | 12/1990 | Miura | B63H 1/28 | 416/235 |
| 5,054,410 A * | 10/1991 | Scarborough | B63B 1/30 | 114/280 |
| 5,083,950 A * | 1/1992 | Suhrbier | B63H 1/18 | 440/82 |

(Continued)

FOREIGN PATENT DOCUMENTS

AU 199744781 B2 4/1998

*Primary Examiner* — William V Gilbert

(57) ABSTRACT

One embodiment of submerged superventilated blades (101) that provide hydrodynamic force to a vessel or aircraft (117) that can lift it above the surface of the water (106) at high speed by creating thrust with a wetted high pressure surface (111), the low pressure surface (112) being covered with a gas filled void in the liquid, thus preventing sudden loss of lift as speed increases due to cavitation or surface venting. Other embodiments are described and shown.

19 Claims, 11 Drawing Sheets

(56) References Cited

U.S. PATENT DOCUMENTS

| | | | | | |
|---|---|---|---|---|---|
| 5,471,942 | A * | 12/1995 | Miller | B63B 32/66 | 114/274 |
| 5,551,369 | A * | 9/1996 | Shen | B63B 1/248 | 114/274 |
| 6,167,829 | B1 * | 1/2001 | Lang | B63B 1/38 | 114/61.12 |
| 6,467,422 | B1 * | 10/2002 | Elms | B63B 39/06 | 114/274 |
| 7,275,493 | B1 * | 10/2007 | Brass | B60V 3/06 | 114/280 |
| 7,637,722 | B1 * | 12/2009 | Koepsel | B63H 1/14 | 416/241 R |
| 2015/0144049 | A1 * | 5/2015 | Daley | B63B 1/26 | 114/274 |

* cited by examiner

SUPERVENTILATED BLADE THAT PROVIDES HYDRODYNAMIC FORCE IN A LIQUID AT HIGH SPEED

CROSS-REFERENCED TO RELATED APPLICATIONS

This application is a CIP of RPA Ser. No. 15/303,203 filed on Oct. 10, 2016, now allowed, and claims the benefit of PPA Ser. No. 61/977,024, filed 2014 Apr. 8, PPA Ser. No. 62/049,867 filed 2014 Sep. 12 and PCT/US2015/024215 filed 2015 Apr. 3 by the present inventor, which are hereby incorporated by reference in their entirety.

FEDERALLY SPONSORED RESEARCH

None.

BACKGROUND

This invention relates to articles such as hydrofoils, propeller blades and other submerged lifting or thrusting articles such as rudders, turbine blades, pump impeller blades and the like, that are required to produce hydrodynamic lifting or thrusting force in a liquid by displacing the liquid through a movement of the article that creates lower pressure in the liquid on one side of the article and higher pressure on the other side.

More explicitly, the liquid is essentially displaced by both sides, being pressed into a new position on the high-pressure side and sucked it into a new position on the low pressure side by the movement of the article. The force needed to accelerate the mass of the liquid in the process of displacing it, is what provides the required hydrodynamic lifting or thrusting force on the article in the opposite direction of the displacement.

However, the low pressure sides of such articles are prone to at least two phenomena that can suddenly and dramatically reduce the hydrodynamic lifting or thrusting ability of these articles as the speed of the movement is increased:

1. Firstly, the low pressure side can develop "cavitation", which is the phenomenon of the liquid transforming to gas, or boiling, due to substantially reduced pressure, caused by the liquid's inability to accelerate fast enough to occupy the space behind the passing article (also referred to as "inertial cavitation"). The boiling of the liquid consumes a large amount of energy that is released when the bubbles of gas collapse, producing tiny points of intense heat (hot enough to melt steel), substantially impairing the materials of the articles they contact. It must be noted that this energy is sacrificial since it does not enhance the lifting properties of the article, and therefor produces drag. Furthermore, the bubbles disturb the displacement of the liquid on the low pressure side of the article and dramatically reduce the hydrodynamic lifting or thrusting force of the article.
2. Secondly, a further drawback in using such articles at or near the surface is the "surface venting" of the article. This is the phenomenon that occurs when the surface air is sucked down into the low pressure side of the article, also disturbing the displacement of the liquid on the low pressure side and dramatically reducing the hydrodynamic lifting or thrusting force of the article.

By this definition, cavitation and ventilation cannot happen at the same place at the same time.

Furthermore, both cavitation and ventilation can occur intermittently, causing unsteady and unpredictable thrust.

SUMMARY

An improved method or apparatus for creating required hydrodynamic lifting or thrusting force in a liquid at high speed with a blade or blades comprising a high_pressure wetted surface and a lower_pressure dry surface is presented. Each blade essentially contains only a high pressure surface in contact with the liquid, the lower pressure surface being substantially covered with an introduced gas, such as surface air, providing a blade that is essentially a single wetted surface, below the liquid surface, "planing" in its own "bubble" or gas filled void in the liquid. This completely eradicates the sudden loss of hydrodynamic lift and drag caused by cavitation. It also eradicates the sudden loss of lift at high speed caused by surface venting, since the blade or blades vent at low speeds and are already fully vented by the time they reach high speed. The blade can be set to a higher angle of attack to compensate for the loss of lift or thrust due to the lower pressure surface not moving the liquid directly.

One possible embodiment of this invention is presented as a system or method of allowing high-speed sailboats using hydrofoils to exceed the speed of conventional non-cavitating hydrofoils.

This embodiment intentionally allows the surface air to be sucked down and delaminate the flow of water on the low pressure surface of a hydrofoil, with the high pressure surface having sufficient angle of attack to provide enough hydrodynamic lift to support and raise the hull of the sailboat above the surface of the water.

A deflector flange may also be used at the leading edge on the low pressure side to encourage introduction of gas at low speed or at a low angle of attack. This deflector flange also permits a more reliable and predictable void allowing the blade to be operated within a wider range of attack angles.

A gas passage may also be used to supply gas to a submerged low pressure surface through a gas port in close proximity to the leading edge of the low pressure surface.

To assist in lifting or thrusting at low speeds, an embodiment may have part of the blade or blades shaped as a conventional non-ventilating hydrofoil, and the angle of attack may be variable.

With any embodiment, the blade or blades may be flexible to account for an uneven surface of the liquid, such as waves or swell. As with current foiling sailboats, the blades may also be independently retractable, having the ability to be lifted out of the water, by being hinged or using any type of sliding mechanism.

Another embodiment of this invention is presented where this type of blade allows high-speed watercraft to exceed the speed where cavitation of conventional NACA hydrofoils is reached.

A further embodiment is a method of introducing a gas, such as exhaust gas or surface air, to the front or low pressure surface of a marine propeller, reducing or totally eliminating cavitation and the sudden loss of thrust incidental to surface venting.

This embodiment may have the gas supplied to the leading edge of the blades through gas ports connected to gas passages that pass through the propeller shaft and/or the hub and blades or alternatively it may be supplied to a gas port that is fixed to the watercraft and the leading edges of the blades pass in close proximity to this gas port, drawing the gas directly onto the low pressure surface of the blade.

This gas port may also be in any suitable shape. A further embodiment may have the gas vented through part of a strut that supports a cutlass bearing, with a gas port directly in front of the leading edges of the propeller. The gas port may also be shaped to correspond directly to the shape of the leading edge of the propeller. This embodiment greatly improves over a surface piercing propellers or partial submerged propellers (PSPs) because it benefits from replacing cavitation with ventilation while being fully submerged thus eliminating the variable and unpredictable performance caused by wave or swell action on the surface. As with other embodiments of this invention, the angle of attack of the blades may be variable.

These embodiments also prevent cavitation erosion of propellers which is a considerable cost savings, particularly on large ocean going commercial or military vessels.

Conventional marine propellers through history have been shaped like "Mickey Mouse" ears because materials were not strong enough to create high-aspect ratio blades. High-aspect ratio blades are far more efficient, but having a higher tip speed, they also tend to cavitate more readily in the tip region as the RPM increases. By venting high-aspect ratio blades made out of stronger modern materials, high RPMs may be achieved, creating longer lasting propellers.

DRAWINGS

REFERENCE NUMERALS

Figure 1:
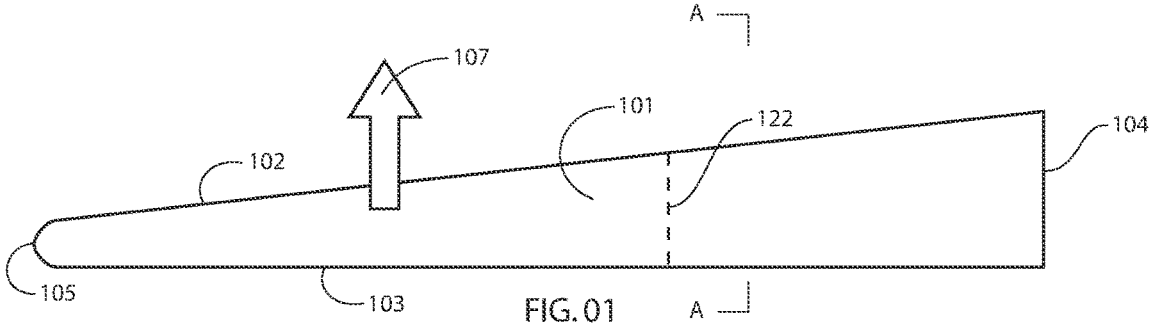
FIGS. 01-04 show planar view illustrations of various embodiments of blades in accordance with the invention.
Figure 2:
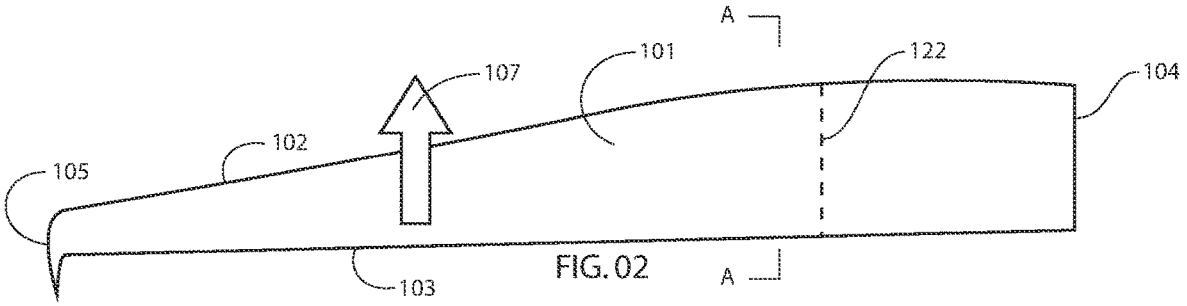
Figure 3:
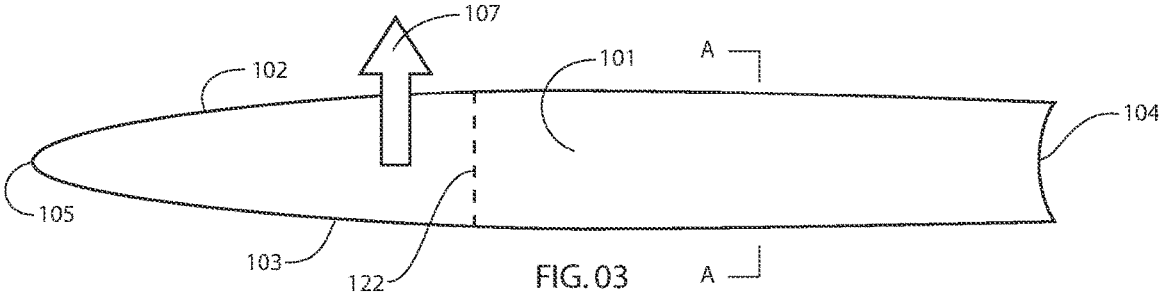
Figure 4:
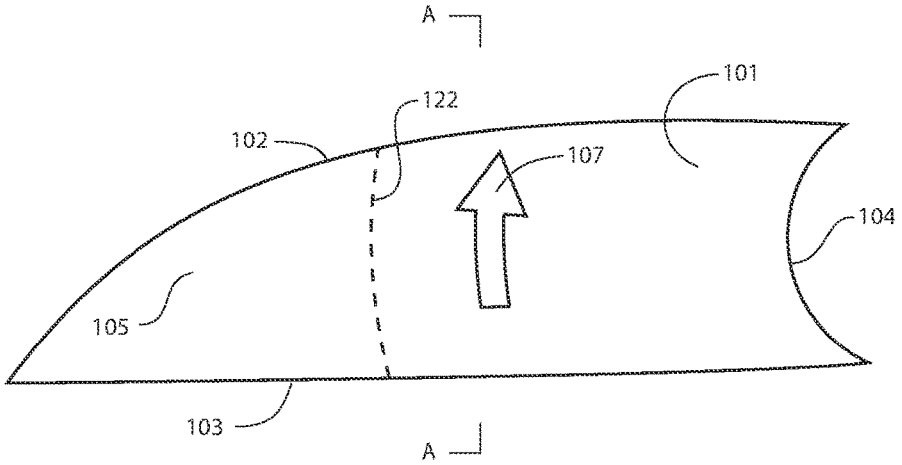

101 blade
102 leading edge
103 trailing edge
104 base
105 tip
106 liquid
107 general direction of blade movement through liquid
108 general direction of liquid acceleration due to blade movement
109 general direction of thrust
110 angle of attack
111 bottom, rear or high pressure wetted surface of blade
112 top, front or low/ambient pressure dry surface of blade
113 gas
114 void in liquid surrounding gas and blade
115 flange
116 increased thickness
117 vehicle such as aircraft or watercraft
118 chine
119 gas passage
120 bend
121 surface of liquid
122 cord of blade
123 reference base plane
124 reference centerline plane
125 seal
126 bifurcation of blade
127 cutlass bearing
128 gas port
129 propeller disc
130 strut
131 propeller shaft
132 propeller hub
133 mast
134 tube
135 counter weight
136 helical path
137 central axis
138 marine propeller

DETAILED DESCRIPTION

As required, detailed embodiments of the present invention are disclosed herein; however, it is to be understood that the disclosed embodiments are merely exemplary of the invention that may be embodied in various and alternative forms. Specific structural and functional details, and shapes disclosed herein are not to be interpreted as limiting, but merely as a basis for the claims and as a representative basis for teaching one skilled in the art to variously employ the present invention.

Description—FIGS. 01 Through 04

Some examples of the many such possible embodiments are shown in FIGS. 01 through 04 where planar views of the embodiments show blade 101 with leading edge 102 and trailing edge 103, and base 104 and tip 105, moving in direction 107.

Operation—FIGS. 01 Through 04

To operate such embodiments, blade 101 is moved through liquid 106 (not shown) as depicted by movement 107.

Figure 5:
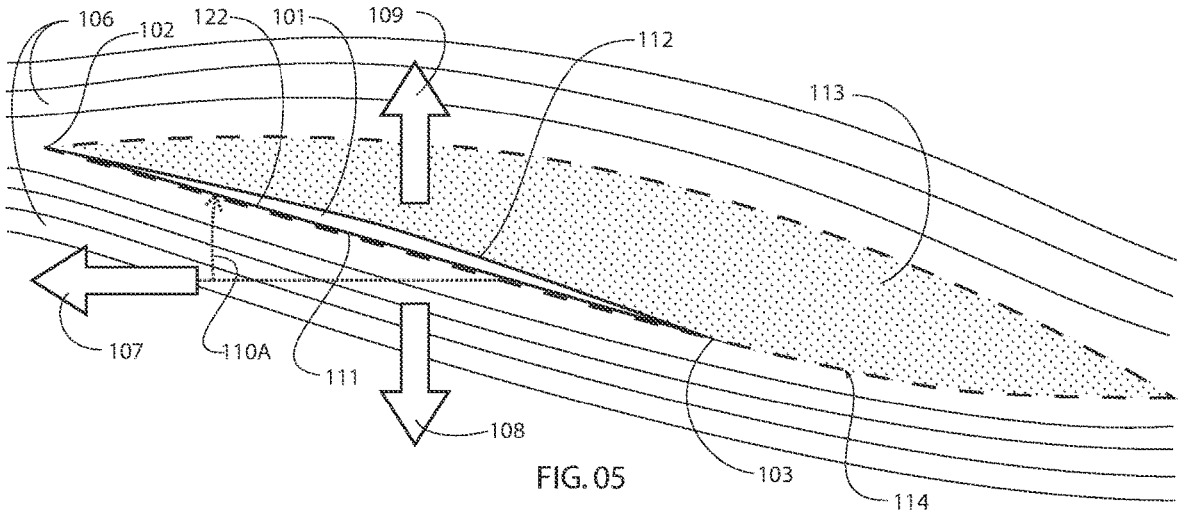
FIGS. 05-07 show a typical cross section illustrations at "A" of the typical embodiments shown in FIGS. 01 through 04.

Description—FIG. 05

FIG. 05 shows a typical cross section at "A" of blade 101 of the typical embodiments shown in FIGS. 01 through 04, where-cross section at "A" is submerged in liquid 106, showing angle of attack 110A between direction of movement 107 and cord of blade 122. Leading edge 102 may be sharp or rounded. Not shown, void 114 may extend behind trailing edge 103 multiple times the width of blade 101. Laminar flow of liquid 106 is depicted.

Operation—FIG. 05

To operate this embodiment, blade 101 is moved through liquid 106 in general direction 107 with enough speed and angle of attack 110A such that sufficiently low pressure is created in liquid 106 adjacent to low pressure side 112 to draw in gas 113 to create void 114 in liquid 106 contiguous to low pressure or dry surface 112. The ambient pressure in gas 113 being high enough in void 104 that cavitation cannot occur on low pressure side 112.

Such movement 107 of blade 101 at angle of attack 110 also causes sufficient liquid 106 to be accelerated with high pressure wetted surface 111 alone in general direction 108, to generate required hydrodynamic thrust on blade 101 in substantially the opposite direction 109.

Since blade 101 becomes fully vented from the surface at relatively low speed, and required hydrodynamic thrust or lift is generated by high pressure surface 111 alone, such embodiments are not prone to great fluctuations of required hydrodynamic thrust or lift due to uncontrolled surface venting as speed in direction 107 increases.

Figure 6:
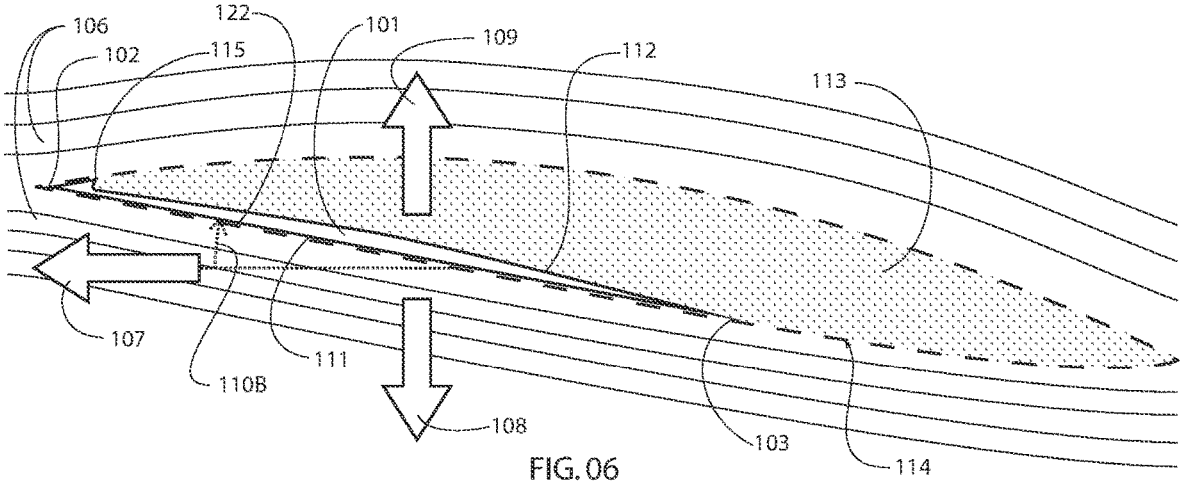

Description—FIG. 06

FIG. 06 shows a similar embodiment as FIG. 05, with the addition of flange 115 at leading edge 102 on low pressure side 112.

Operation—FIG. 06

Operating this embodiment is similar to FIG. 05 with the addition of flange 115 which induces low pressure on side 112 to draw in gas 113 at a lower angle of attack 110B and at lower speeds than the embodiment of FIG. 05. Induced low pressure develops void 114 substantially, allowing blade 101 to be operated within a wider range of angle of attack 110.

Figure 7:
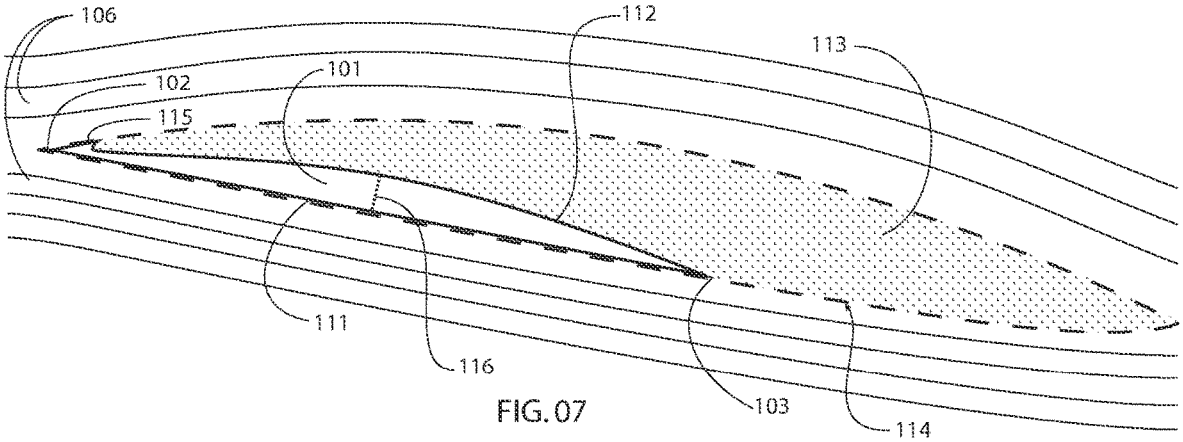

Description—FIG. 07

FIG. 07 shows an embodiment with the addition of increased thickness 116 of blade 101.

Operation—FIG. 07

Operating this embodiment is similar to previous embodiments with the addition of structural strength provided by increased thickness 116, which also allows blade 101 to produce required hydrodynamic lift or thrust, at a speed below that which draws in gas 113 to create void 114, similar to the known ability of a conventional hydrofoil.

Figure 8:
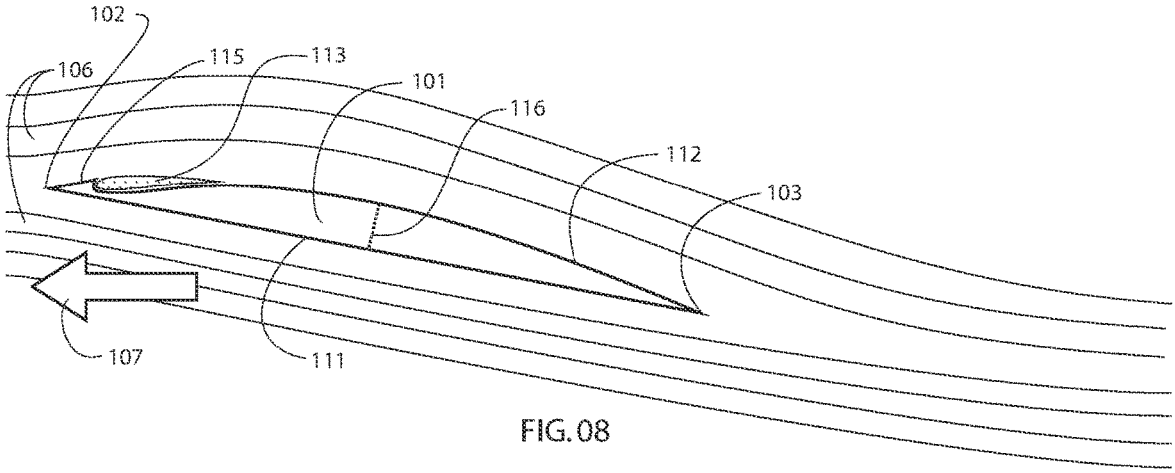
FIGS. 08-10 show possible cross section illustrations of embodiments that can operate as a non-vented hydrofoil at low speeds and as a superventilated blade in accordance with this invention at high speed.
Figure 9:
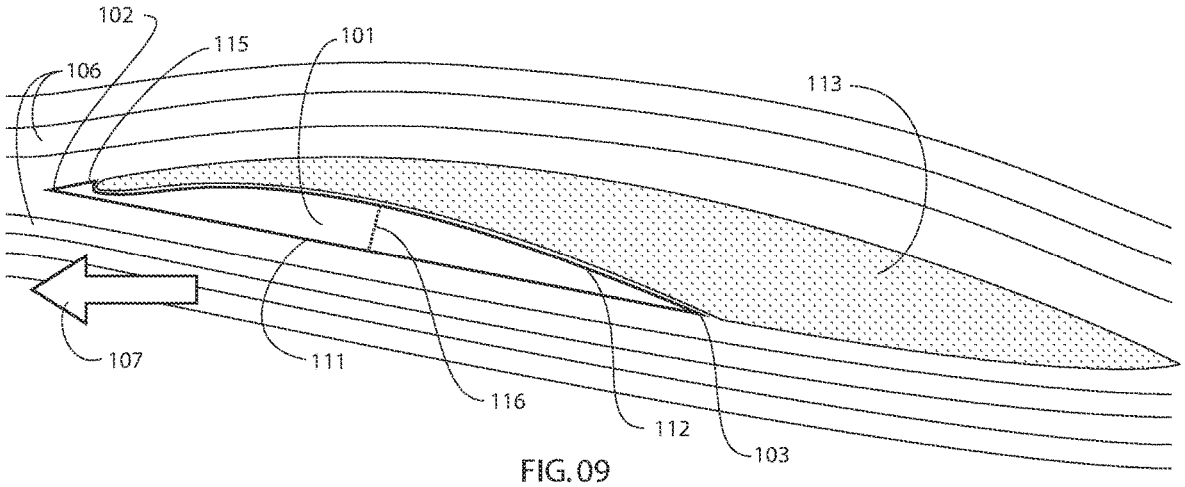
Figure 10:
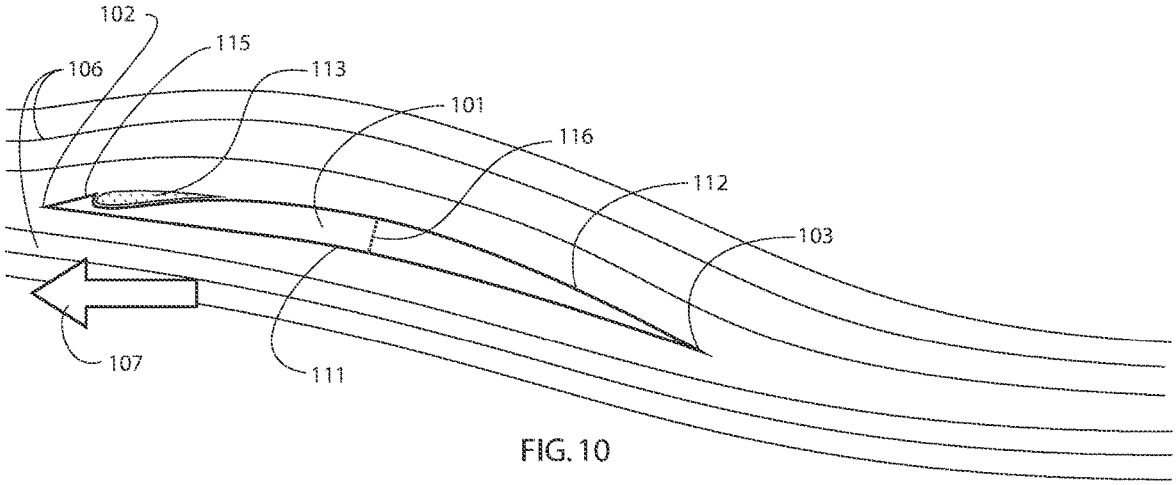

Description—FIGS. 08 through 10

FIGS. 08 and 09 show an embodiment which is another combination of this invention and a conventional hydrofoil, where blade 101 has increased thickness 116 such that the after part of blade 101 has a cross section typical of a conventional hydrofoil.

FIG. 10 shows blade 101 with surface 111 as concave. Not shown, surface 111 may be convex or a combination of both concave and convex.

Operation—FIGS. 08 Through 10

Because a conventional non-venting hydrofoil known in the art may have better lifting properties at low speed, a combination is presented to provide hydrodynamic lift when blade 101 is traveling in direction 107 below speed that induces venting. A small amount of gas 113 may be drawn in behind flange 115 to complete the hydrofoil shape. This space may also be filled with an eddy of liquid 106.

FIG. 09 shows the operation of the same embodiment as FIG. 08 with blade 101 traveling in direction 107 at high speed and providing required hydrodynamic lift in accordance with this invention.

Figure 11:
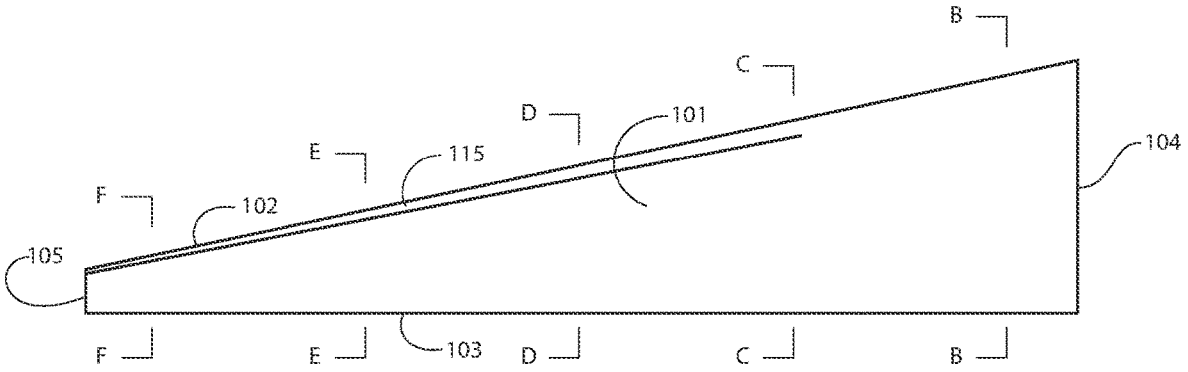
FIGS. 11-13 show possible planar, front end elevations and cross section view illustrations of an embodiment which is a combination of a vented blade and a conventional non-venting hydrofoil.
Figure 12:
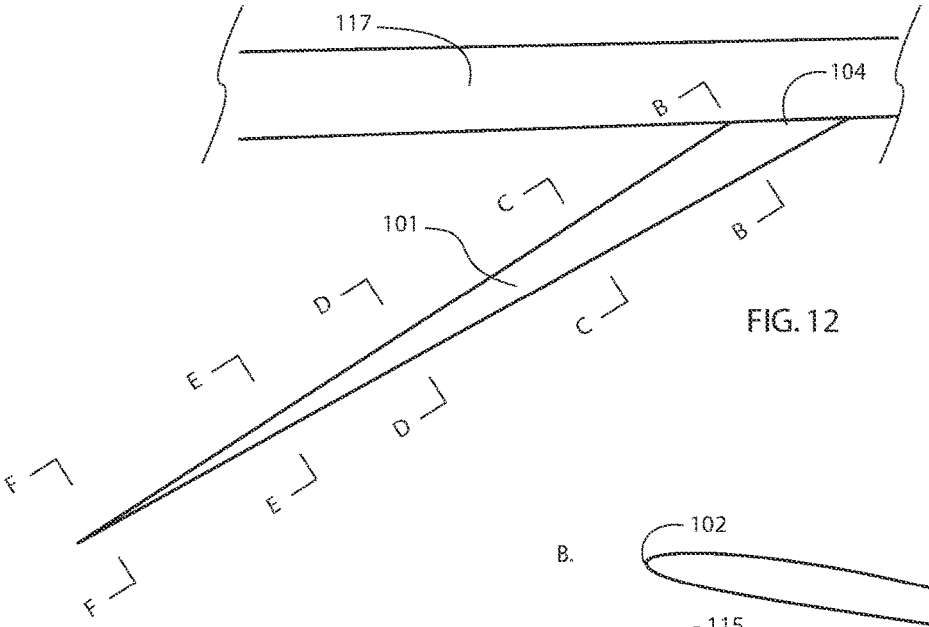
Figure 13:
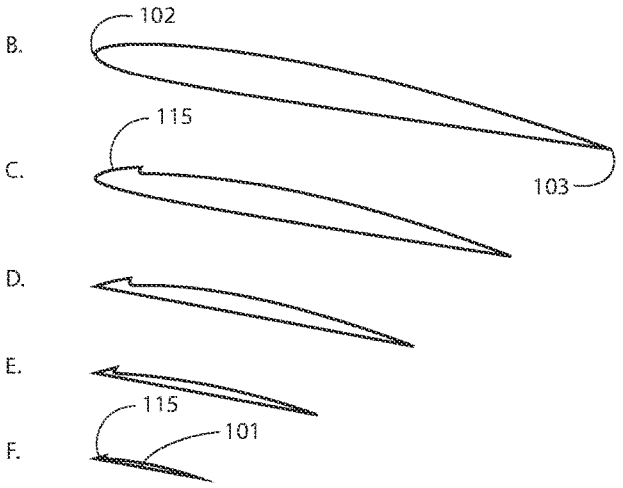
Figure 14:
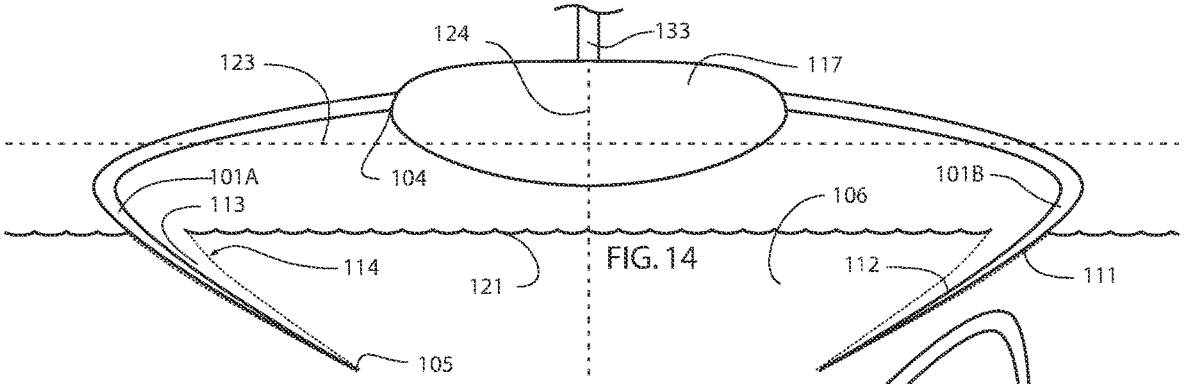
FIGS. 14-17 show vented blades being used on a sailing craft hull.

Description—FIGS. 11 Through 13

FIGS. 11 through 13 shows a type of embodiment which is a combination of this invention and a conventional hydrofoil, where part of blade 101 has a cross section similar to a conventional NACA hydrofoil at B, and sections C through F show a progression of the transition to a single high speed wetted surface as shown in this invention.

Operation—FIGS. 11 Through 13

Because a conventional NACA hydrofoil known in the art has better lifting properties at low speed, a combination is presented whereby the upper portion of blade 101 can give more efficient lift at low speeds and the lower portion of blade 101 will become fully vented and operate in accordance with the operation of FIGS. 05 through 07 at high speeds.

Description—FIGS. 14 Through 17

FIGS. 14 through 17 show an embodiment of this invention where blades 101A and 101B are part of the hydrofoil system that supports a sailing craft with mast 133 above the surface of the water.

Operation—FIGS. 14 Through 17

Figure 15:
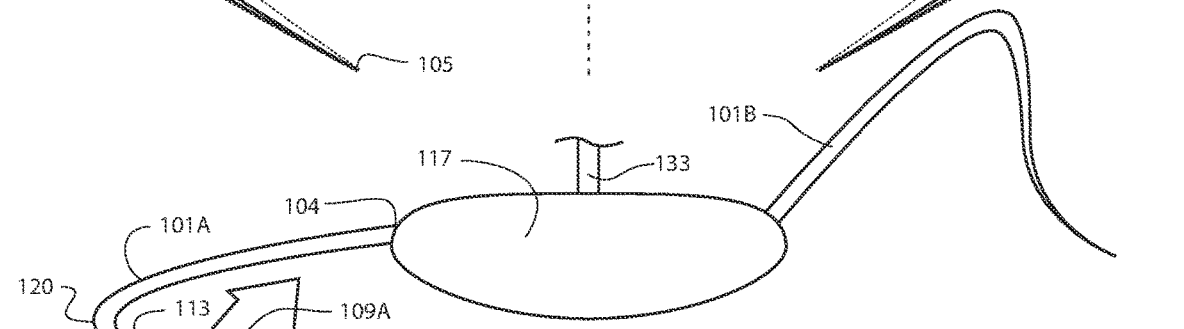
Figure 16:
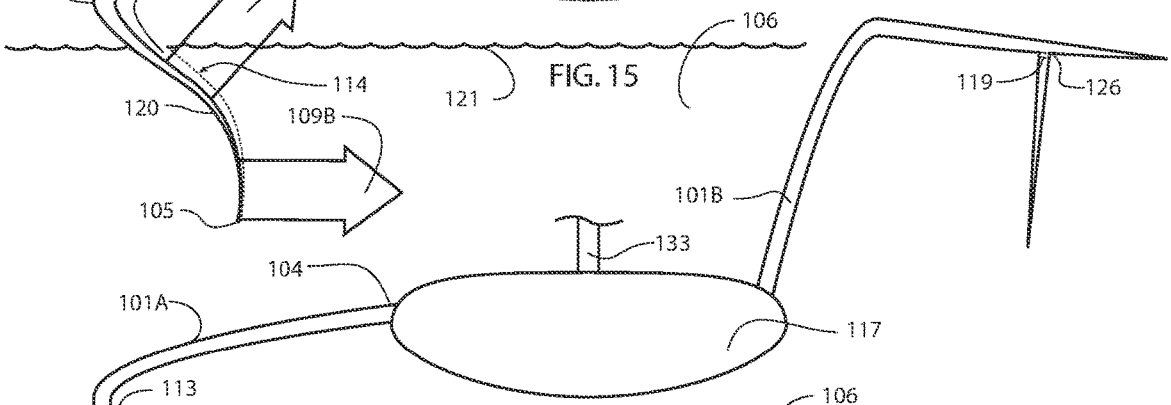
Figure 17:
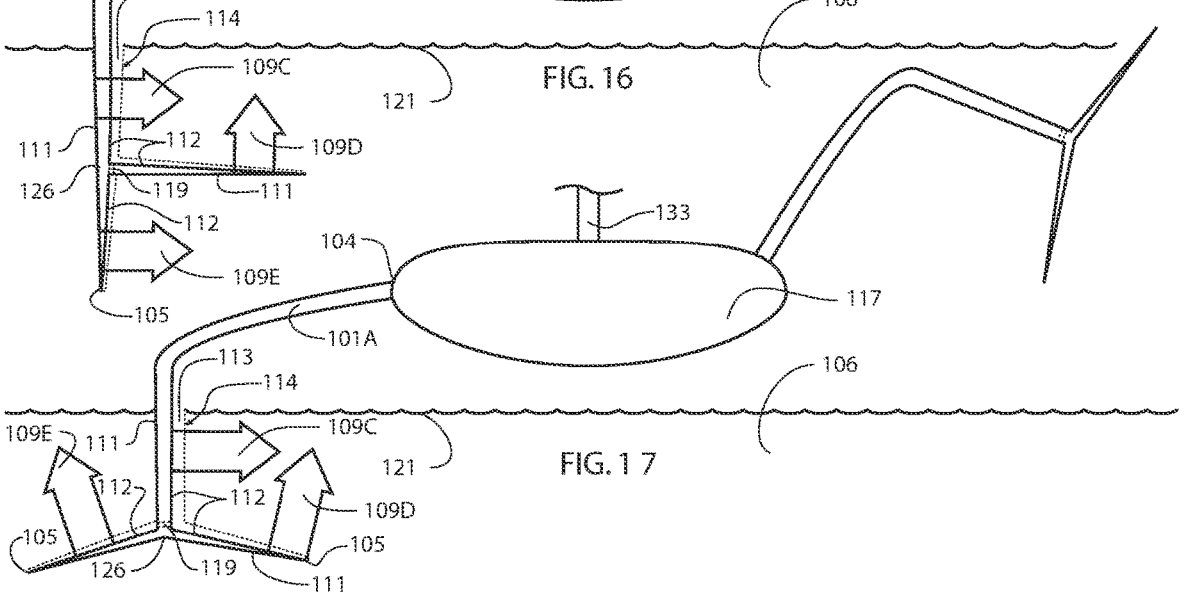
Figure 18:
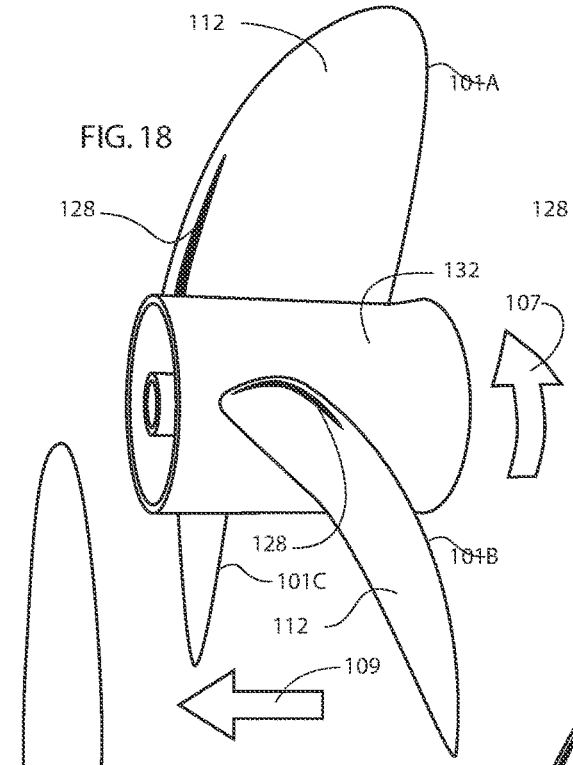
FIGS. 18-21 show possible perspective view illustrations of embodiments which are boat propellers.

With these embodiments movement 107 (not shown) provides thrust 109 both to produce lift and to counter leeway. Blades 101A and 101B may be independently lifted clear liquid 106 to reduce drag. FIG. 15 shows bends 120 that create the different angles of general direction of thrust 109A and 109B. The sum total general direction of thrust 109 therefore varies with the amount of blade 101A or 101B in liquid 106. FIG. 17 shows bifurcation 126 causing substantially upward thrust. Gas passage 119 allows venting of both parts of blades 101A or 101B between bifurcation 126 and tips 105.

Description—FIGS. 18 Through 21

Figure 19:
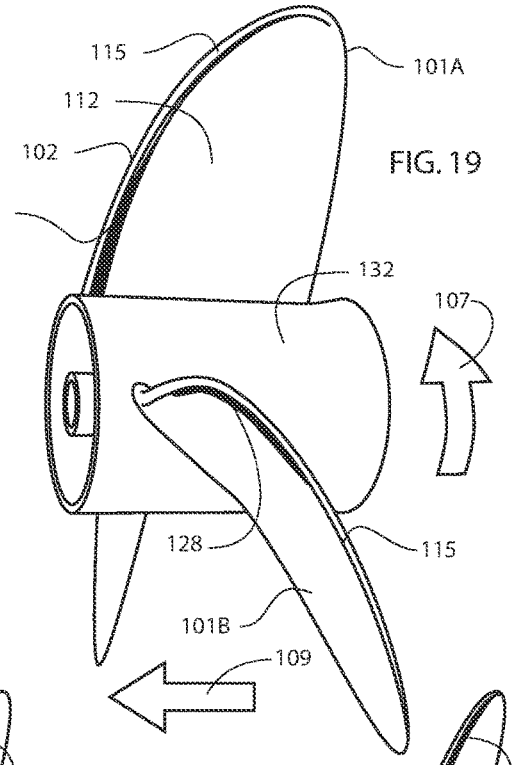
Figure 20A:
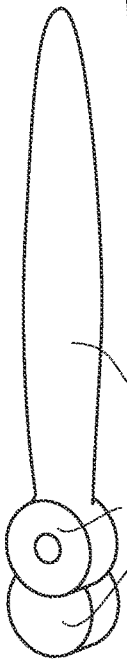
Figure 20:
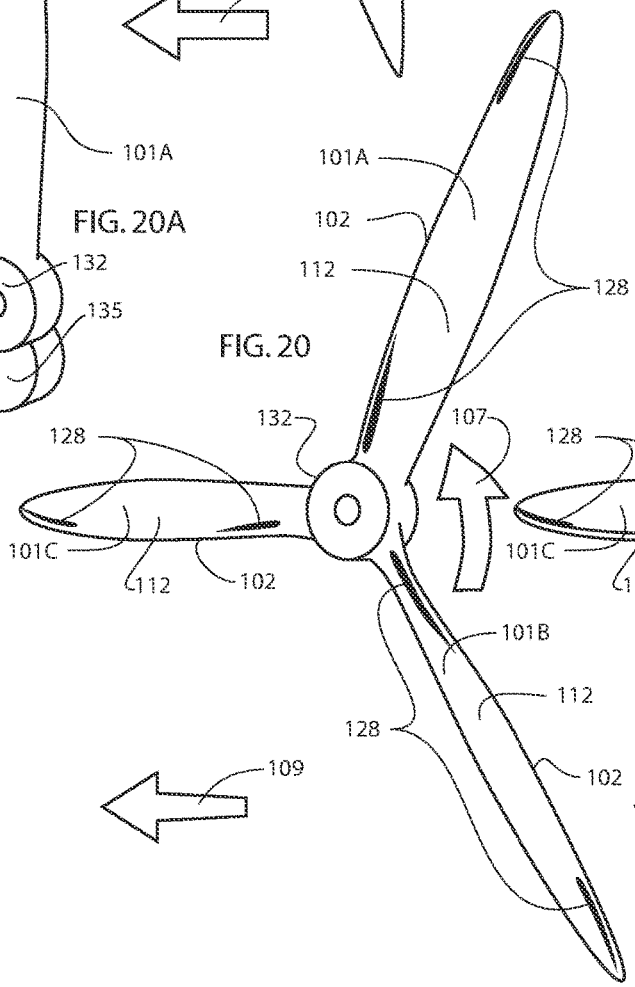
Figure 21:
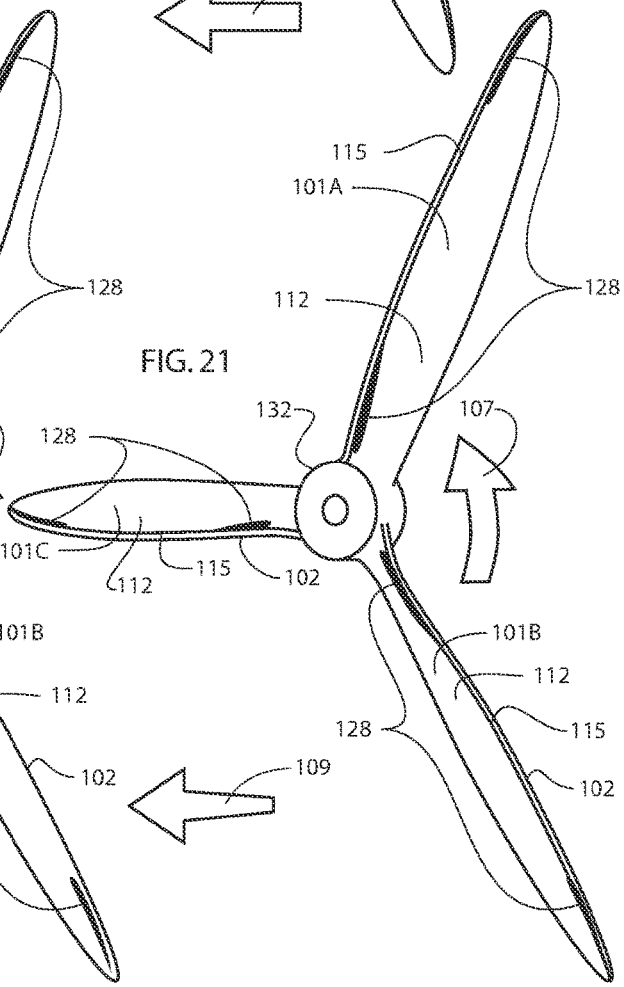

FIGS. 18 through 21 show perspective views of embodiments of this invention with blades 101A, B and C attached to propeller hub 132, rotating in direction 107 and possible locations of gas ports 128 in close proximity to leading edge 102 on low pressure surface 112 of blades 101. FIGS. 20 and 21 show examples of embodiments with blades 101 having a high aspect ratio. FIGS. 19 and 21 show examples of embodiments with blades 101 having flange 115 at leading edge 102. FIG. 20A shows an embodiment of the current invention with a single blade 101 and counter weight 135.

Operation—FIGS. 18 Through 21

When the embodiment shown in FIGS. 18 through 21 are rotated in direction 107 a low pressure is created in liquid 106 (not shown) such that gas 113 (not shown) can be drawn through gas passage 119 (not shown) and exit blades 101 through gas ports 128, creating voids 114 (not shown) in liquid 106 (not shown) contiguous to low pressure surfaces 112 such that blades 101 cannot cavitate while high pressure surfaces 111 (not shown) supply enough thrust to propel blades 101 in direction of thrust 109.

Description—FIGS. 22 Through 25

Figure 22:
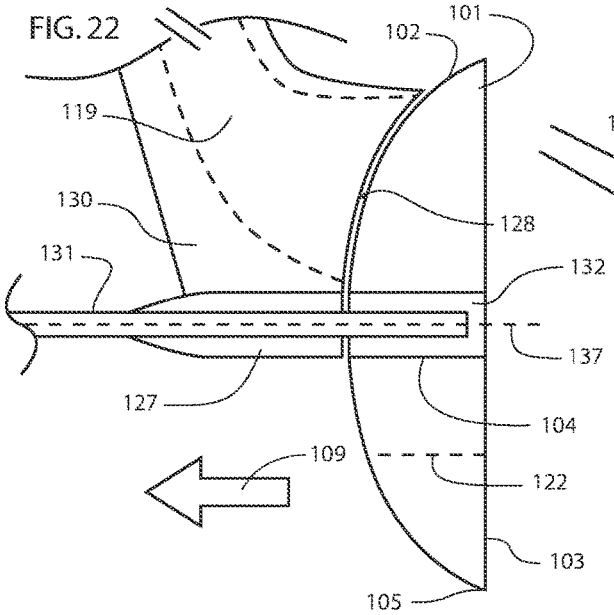
FIGS. 22-25 show possible side elevations and perspective view illustrations of embodiments which are boat propellers.
Figure 23:
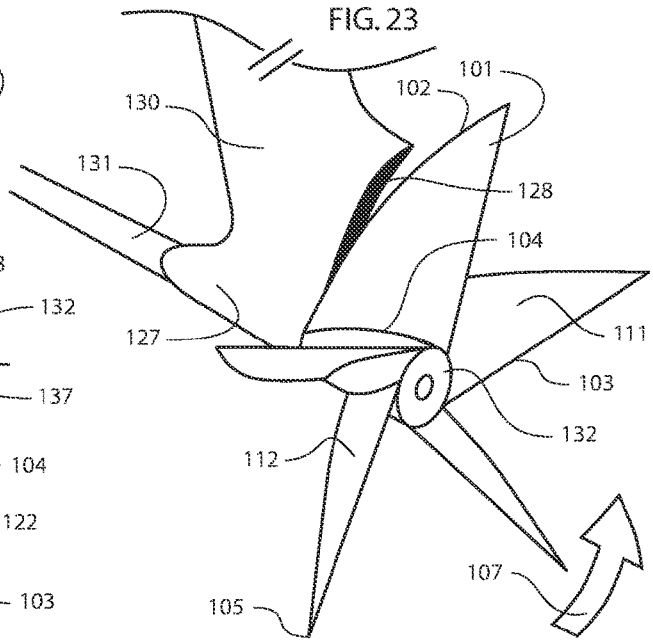
Figure 24:
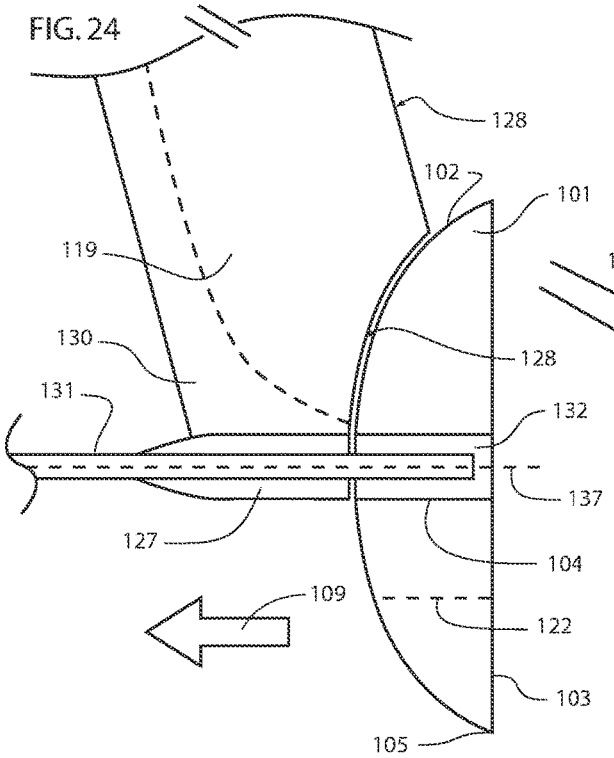
Figure 25:
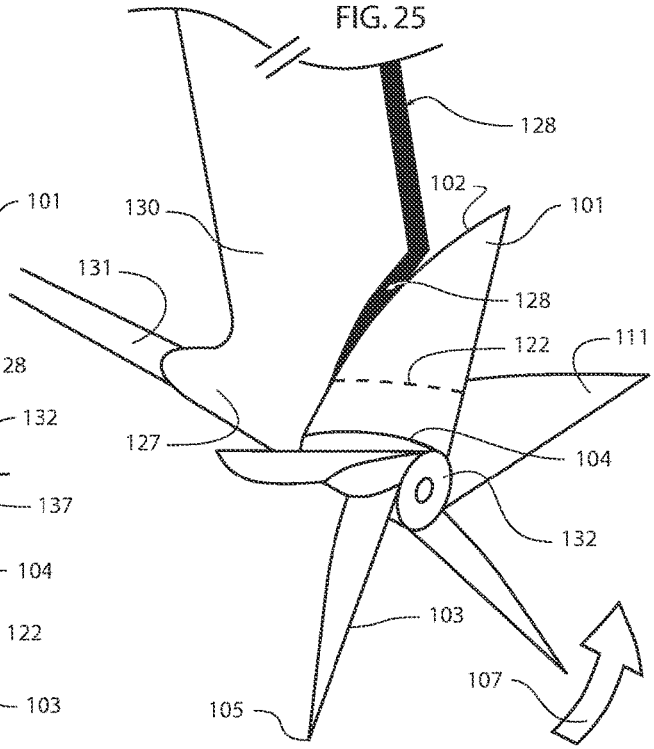

FIGS. 22 through 25 show views of embodiments of this invention with blades 101 attached to propeller hub 132, with leading edges 102 of blades 101 rotating in direction 107 and passing in close proximity to gas port 128. FIGS. 22 and 23 show an example of an embodiment with gas passage 119 enclosed in strut 130. FIGS. 24 and 25 show an example of an embodiment with gas port 128 extending up the aft of strut 130.

Operation—FIGS. 22 Through 25

When the embodiments shown in FIGS. 22 through 25 are operated, blades 101 are rotated in direction 107 and a low pressure is created on low pressure surfaces 112 in liquid 106 (not shown) such that gas 113 (not shown) can be drawn through gas passage 119 and exit through gas port 128, creating voids 114 (not shown) in liquid 106 (not shown) contiguous to low pressure surfaces 112 such that blades 101 cannot cavitate while high pressure surfaces 111 supply enough thrust to propel blades 101 in direction of thrust 109. FIG. 25 shows strut 130 being a fully vented strut.

Description—FIGS. 26 Through 31

Figure 26:
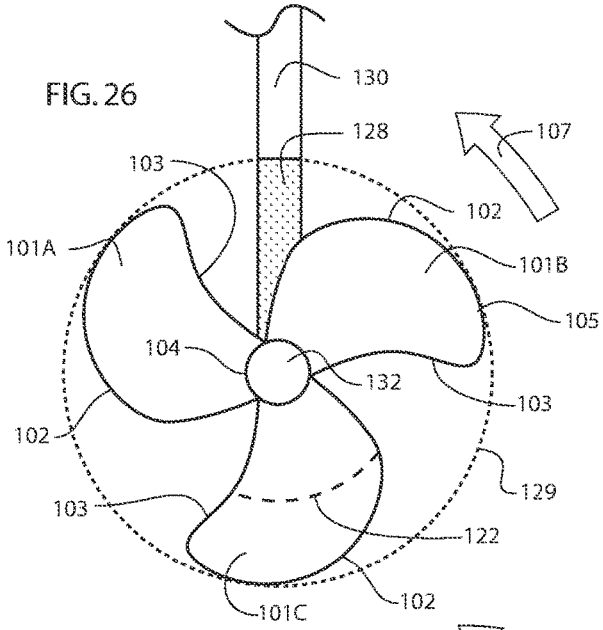
FIGS. 26-31 show end elevations of possible embodiments for possible gas port positions in front of the propeller.
Figure 27:
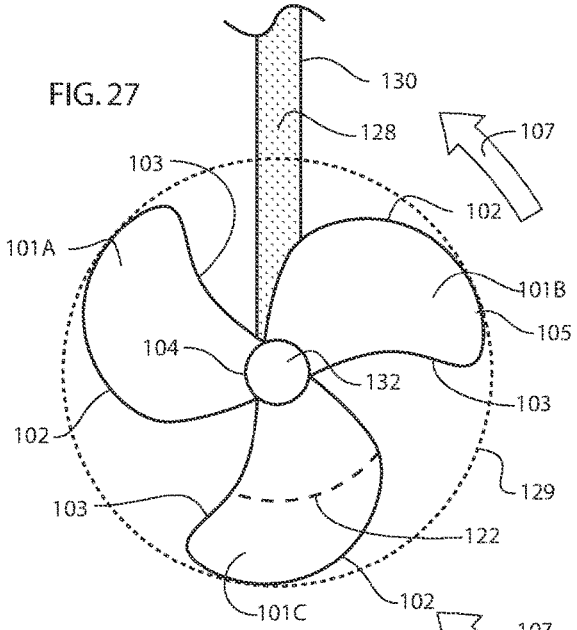
Figure 28:
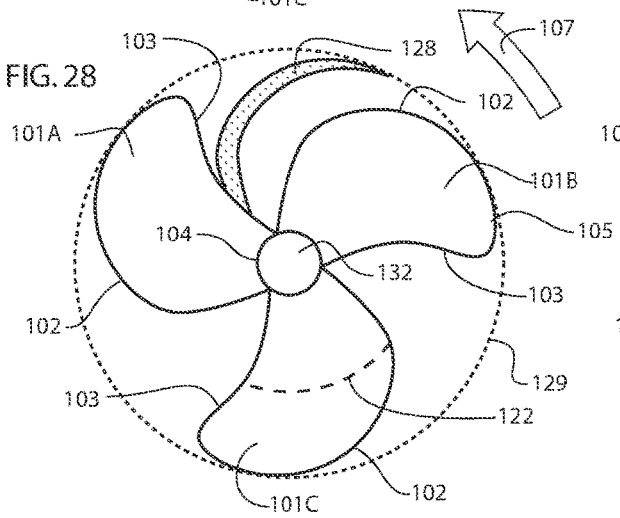
Figure 29:
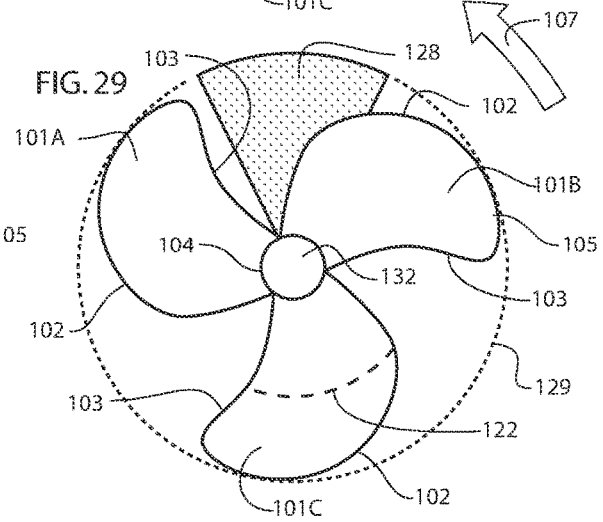
Figure 30:
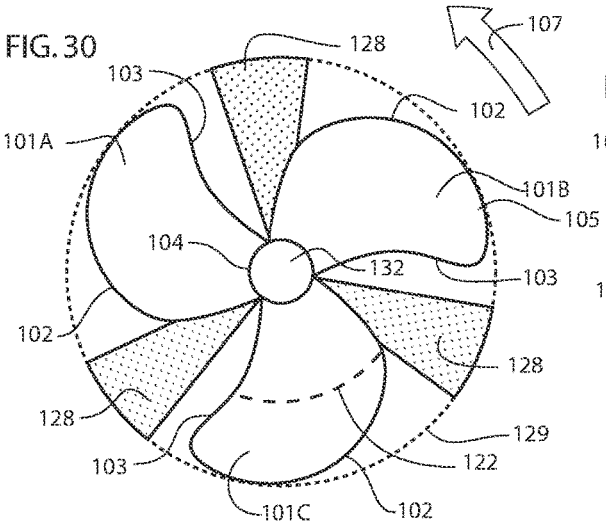
Figure 31:
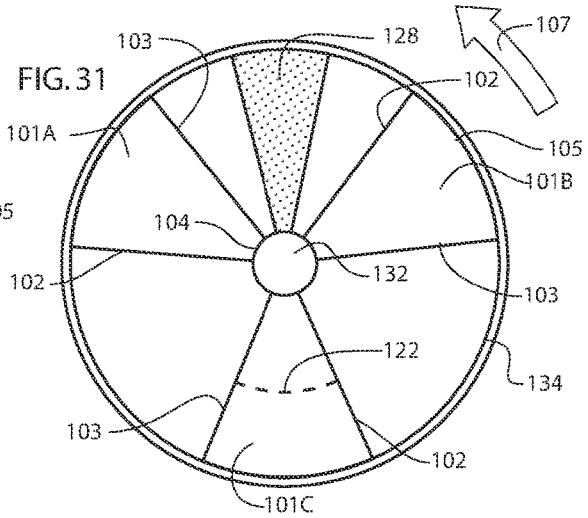

FIGS. 26 through 31 show rear projections of embodiments of this invention with blades 101 attached to propeller hub 132, with leading edges 102 of blades 101 rotating in direction 107 and passing in close proximity to gas port 128. FIG. 26 shows an example of an embodiment with gas passage 119 enclosed in strut 130. FIG. 25 shows an example of an embodiment with gas port 128 extending up the aft of strut 130. FIG. 28 shows gas port 128 in a shape that corresponds to the shape of leading edge 102. FIGS. 29 and 30 show gas port 128 as a segment or segments of propeller disc 129. FIG. 31 shows blades 101 in a tube as in a jet-drive or shroud or in a pump.

Operation—FIGS. 26 Through 31

Operation of FIGS. 26 through 31 is similar to previous embodiments.

Figure 32:
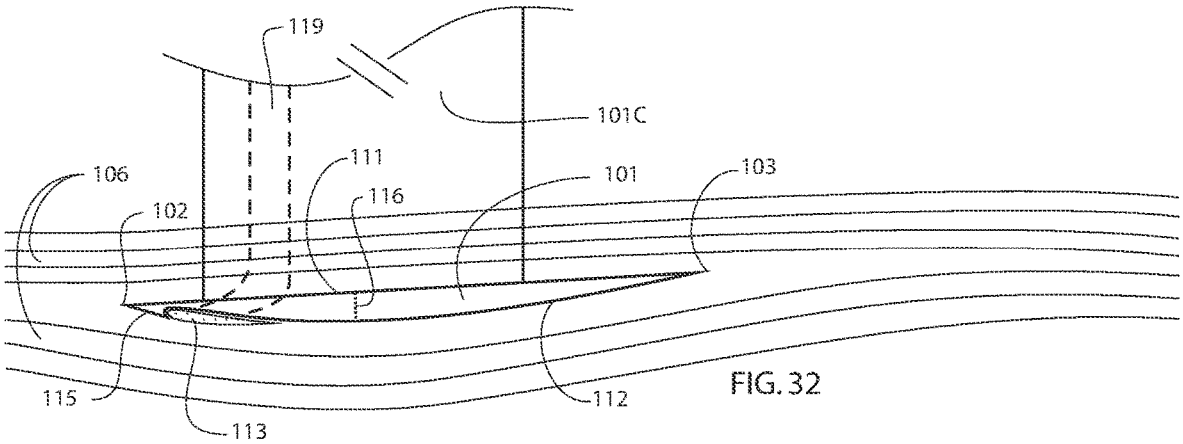
FIGS. 32 and 33 show possible side view illustrations of the embodiment in FIGS. 08-10 that is inverted and attached to a pylon or boat rudder.
Figure 33:
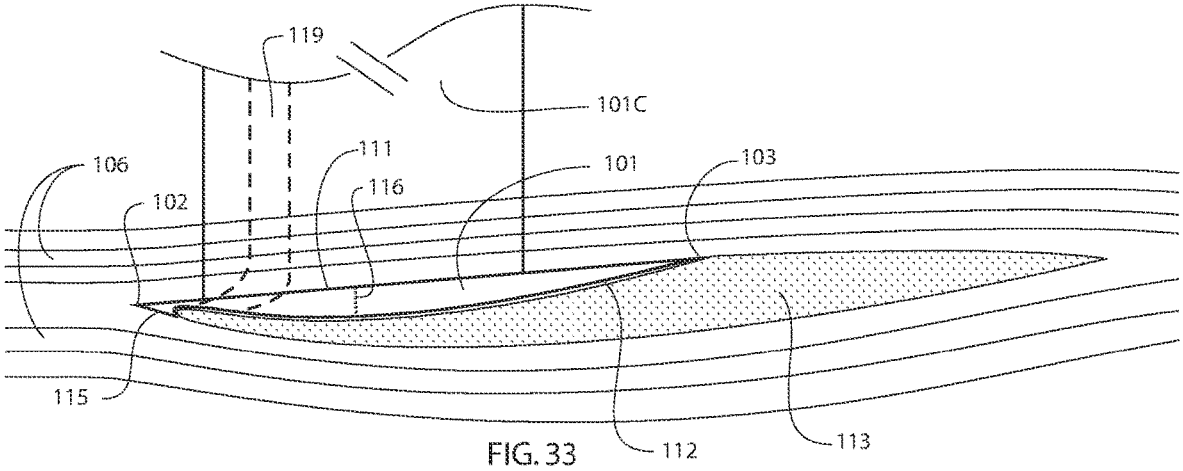

Description—FIGS. 32 and 33

FIGS. 32 and 33 show an embodiment of this invention where blade 101 is attached perpendicularly to another blade 101C, such that it may be inverted to provide a downward thrust. Blade 101C may have gas passage 119 to supply gas 113 to low pressure side 112.

Operation—FIGS. 32 Through 33

This embodiment is operated much the same as in FIGS. 8 and 9, but providing downward thrust at both low speed and high speed, gas 113 being drawn in through gas passage 119.

Figure 34:
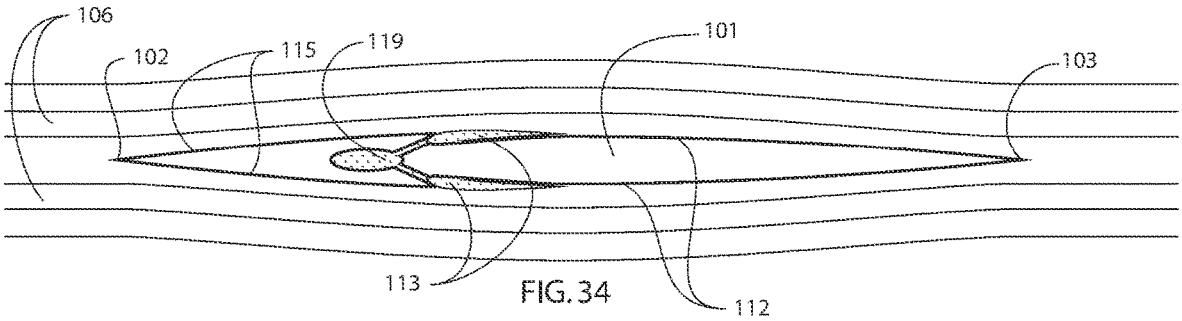
FIGS. 34-35 show possible top view illustrations of an embodiment as a pylon or boat rudder, traveling at both low speed and high speed respectively.
Figure 35:
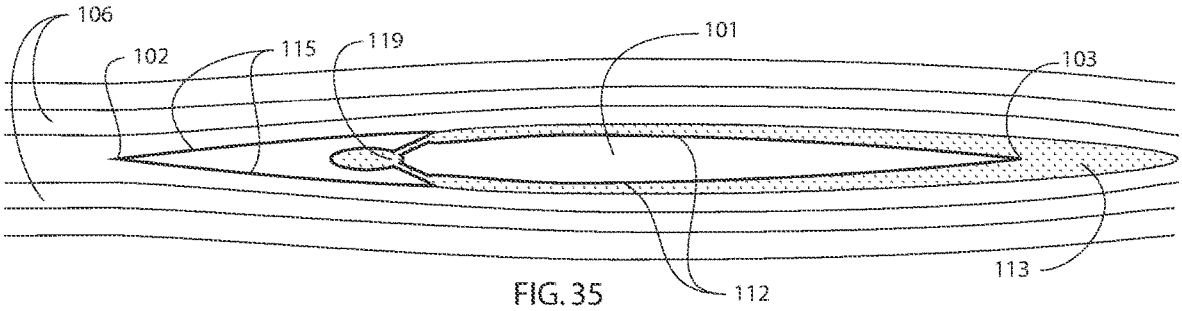

Description—FIGS. 34 and 35

FIGS. 34 and 35 show an embodiment of this invention where blade 101 is symmetrical about the forward and aft axis, both sides being similar to low pressure surface 112 with flange 115. When used vertically as a ruder or pylon as with blade 101A in FIGS. 23 and 24, gas 113 may be drawn in through gas passage 119.

Operation—FIGS. 34 and 35

This embodiment may be operated at both high speed and low speed, with neutral thrust in either direction, with gas 113 being drawn in to prevent cavitation on either side.

Figure 36:
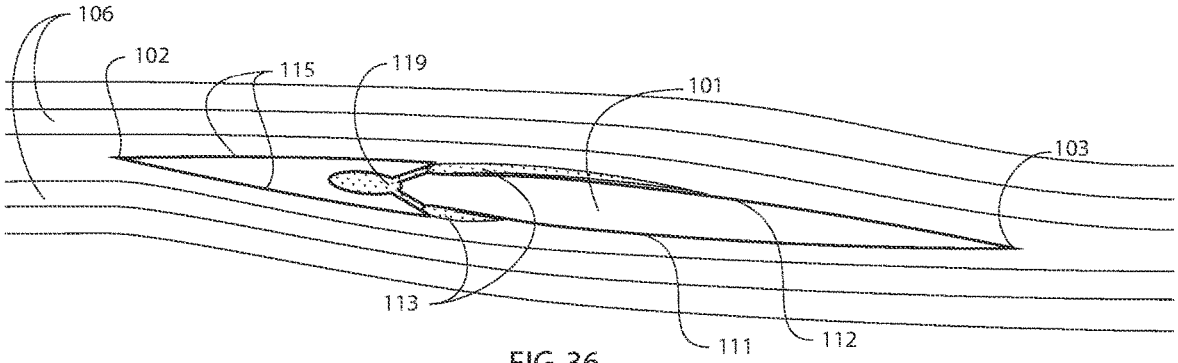
FIGS. 36-37 show possible top view illustrations of an embodiment as a pylon or boat rudder, traveling at both low speed and high speed respectively with deflection of liquid to one side.
Figure 37:
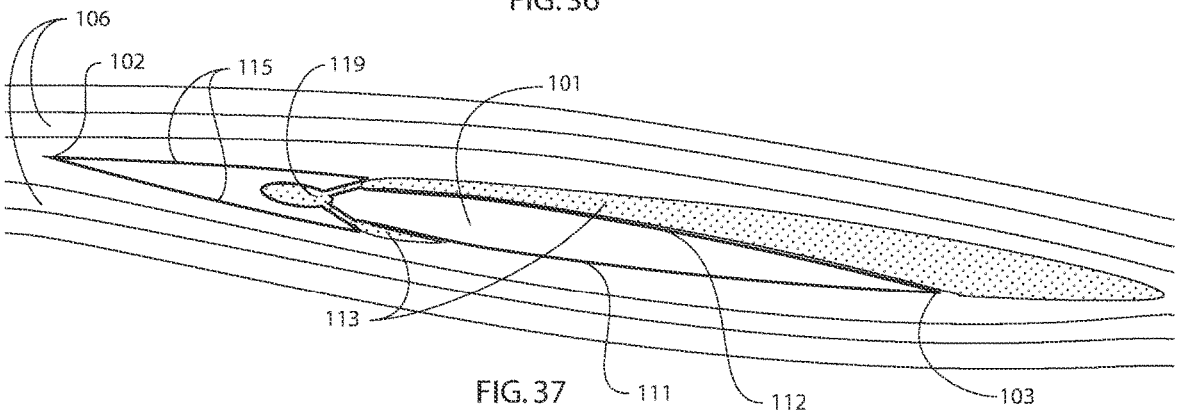

Description—FIGS. 36 and 37

FIGS. 36 and 37 show the same embodiment as FIGS. 34 and 35 where blade 101 can be angled to provide thrust to one side or the other as in the case of a rudder or center board.

Operation—FIGS. 36 and 37

This embodiment may be operated to provide thrust to one side or the other at both high speed and low speed, with gas 113 being draw in to prevent cavitation on either side.

Figure 38:
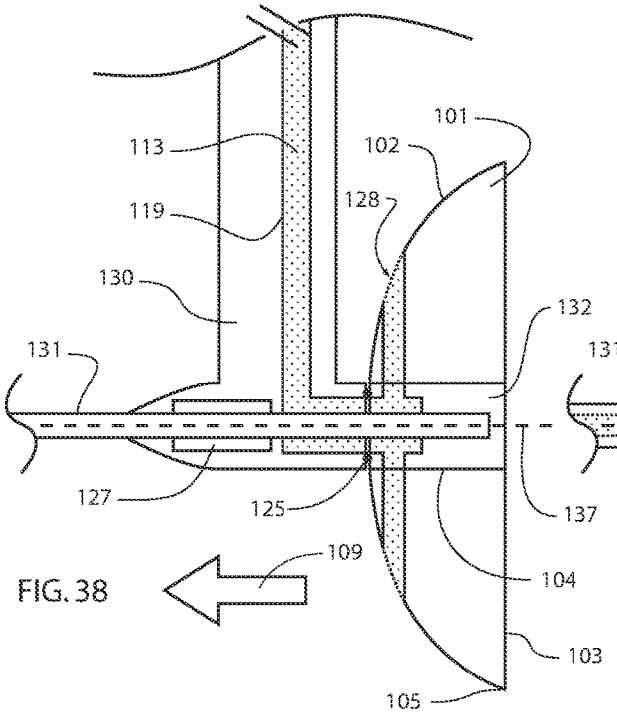
FIG. 38 and FIG. 39 show possible side view illustrations of an embodiment of a boat propeller where the leading edges are vented through the hub and blades.
Figure 39:
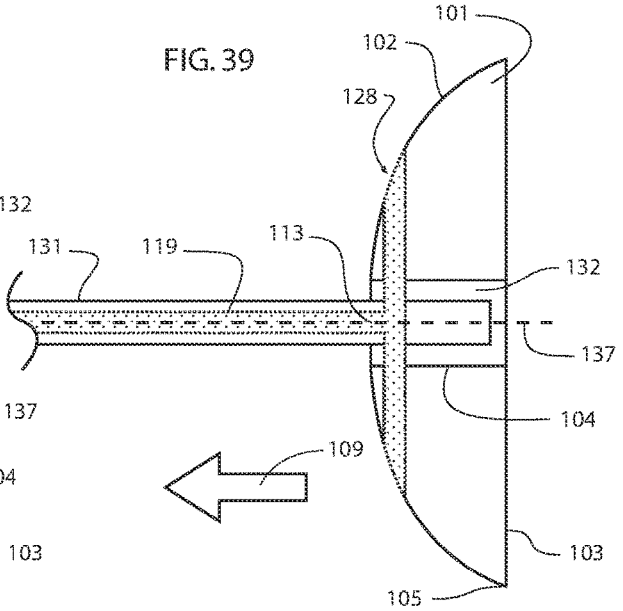

Description—FIGS. 38 and 39

FIGS. 38 and 39 show side view elevations of further possible embodiments of a marine propeller with gas 113 being released through gas ports 128 at predetermined places in close proximity to leading edge 102 on low pressure side 112 and gas passages 119 passing through propeller hub 132 and blades 101. FIG. 38 shows gas passage 119 passing through strut 130 and FIG. 39 shows gas passage passing through propeller shaft 131.

Operation—FIGS. 38 and 39

To operate these embodiments, propeller shaft 131 rotates propeller hub 132 and blades 101 causing low pressure in liquid 106 (not shown) contiguous to low pressure surface 112, such that low pressure in liquid 106 (not shown) draws gas 113 through gas passage 119 and out of gas ports 128 such that gas 113 forms void 114 (not shown) in liquid 106 (not shown) contiguous to low pressure surface 112, such that blades 101 cannot cavitate while high pressure surfaces 111 supply enough thrust to propel blades 101 in direction of thrust 109. FIG. 38 also shows seal 125 between propeller hub 132 and strut 130.

Figure 40:
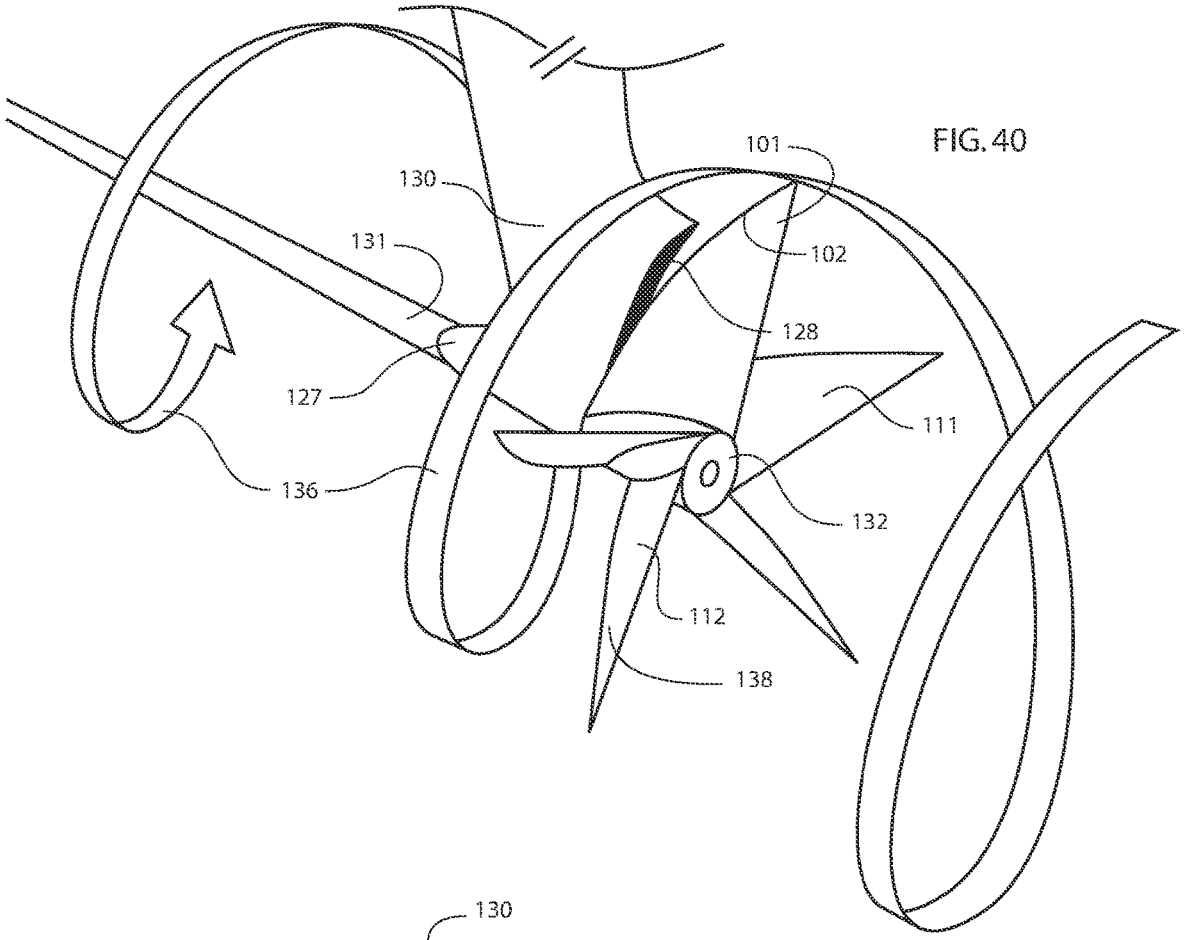
FIG. 40 and FIG. 41 show a perspective illustration and a side view illustration of an embodiment of the invention.
Figure 41:
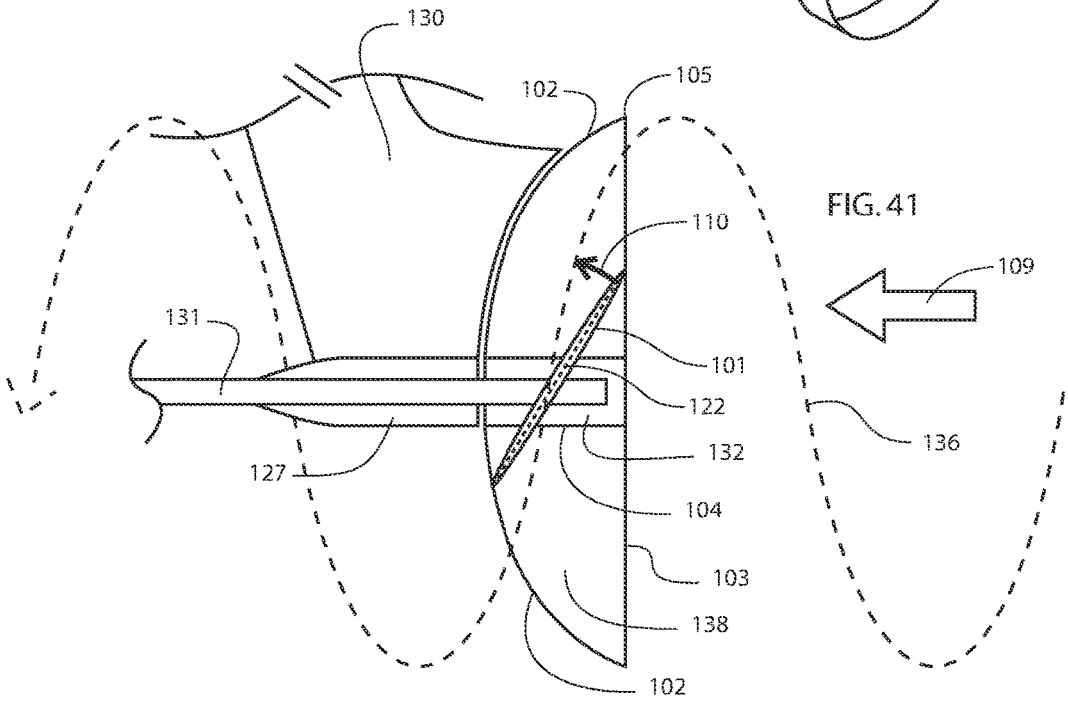

Description—FIGS. 40 and 41

FIG. 40 shows a perspective view illustration and a side view illustration of an embodiment of a marine propeller 138 with blades 101 traveling along helical path 136.

Operation—FIGS. 40 and 41 To operate these embodiments, propeller shaft 131 rotates propeller hub 132 and blades 101 causing low pressure in liquid 106 (not shown) contiguous to low pressure surface 112, and a high pressure contiguous to high pressure surface 111, causing thrust against blades 101, such that marine propeller 138 moves in general direction of thrust 109, causing blades 101 to move along helical paths as shown with helical path 136.

I claim:

1. A vehicle having a general direction of movement relative to a liquid that has a surface, said surface being essentially a free surface shared with a gas, said gas being at an ambient pressure, and said general direction of movement being substantially parallel to said surface, comprising:

a. said vehicle having a reference base plane established as a mean waterline plane when said vehicle is floating at rest at said surface of said liquid, and a centerline reference plane extending along a central longitudinal axis and being perpendicular to said reference base plane, b. said vehicle having at least one pair of blades, said pair of blades comprising two individual blades opposing one another about said reference centerline plane, each of said blades having a base, a tip, a leading edge, a trailing edge, a low pressure surface and a high pressure surface, each one of said leading edges and respective said trailing edges converging toward respective said tips, said leading edges being substantially closer to said trailing edges at said tips than at said bases, and each one of said low pressure surfaces and respective said high pressure surfaces converging at respective said leading edges and at respective said trailing edges, and said pair of blades being attached to said vehicle and extending from said vehicle in such a way that said tips can be substantially below said waterline plane, c. said pair of blades having attachments to said vehicle at predetermined points such that in operation at least one of said blades extend substantially downward toward said tips and penetrate said liquid's surface, said blades having an angle of attack in said liquid defined respectively by an angle between said general direction of movement of said vehicle in said liquid and a chord of said blades, and said blades being configured such that in operation an exposed portion of said blades is above said liquid's surface, and a submerged portion of said blades is below said liquid's surface, and such that said leading edges part said liquid at said submerged portion, said blades being further configured such that in operation at a predetermined speed, said angle of attack provides a high pressure in said liquid on said submerged portion of said high pressure surfaces of said blades and a low pressure in said liquid on said low pressure surfaces of said blades that is below said liquid's surface, said high pressure providing thrust in a combination of a lateral direction and an upward direction, said low pressure being substantially low enough to draw down said gas from said liquid's surface, said gas being essentially drawn down contiguous to said low pressure surface, and said gas creating voids in said liquid contiguous to said low pressure surfaces, said voids being filled with said gas at substantially said ambient pressure, and in operation said voids being able to extend behind said blades in said liquid, and each of said submerged portions of said high pressure surfaces of said blades being essentially a wetted high pressure surface, and each of said low pressure surfaces being essentially an ambient pressure dry surface, whereby said blades are in a vented state, and whereby said vented state prevents cavitation of said blades, and d. said angle of attack being further configured such that in operation, at said predetermined speed, said upward thrust be sufficient to support part or all of said vehicle at a predetermined height above said liquid's surface.

2. The vehicle of claim 1 further including a deflector flange at a predetermined section of said leading edges on said low pressure surfaces of said blades, said deflector flange configured such that in operation, said deflector flange deflects said liquid away from said low pressure surfaces, whereby substantially reducing said predetermined speed and said predetermined angle of attack required to provide said low pressure to draw down said gas from said surface to create said voids in said liquid contiguous to said low pressure surfaces.

3. The vehicle of claim 1 wherein said blades further including at least one gas passage connected to at least one port, allowing said gas to be introduced to said low pressure surfaces.

4. The vehicle of claim 1 wherein said attachments of said blades to said vehicle comprise mechanisms which allow said blades to be individually retracted or removed from said liquid.

5. The vehicle of claim 1 wherein said leading edges and said trailing edges of said blades are sharp, rounded or a combination thereof.

6. The vehicle of claim 1 wherein said low pressure surfaces and said high pressure surfaces of said blades are planar, convex, concave or a combination thereof.

7. The vehicle of claim 1 further comprising means for adjusting said angle of attack of said blades during operation.

8. The vehicle of claim 1 wherein said angle of attack of said blades varies between said base and said tip.

9. The vehicle of claim 1 wherein blades are curved at predetermined angles and configured such that in operation said curves provide different angles of thrust.

10. The vehicle of claim 1 wherein a portion of said pair of blades are bifurcated.

11. The vehicle of claim 1 wherein a section of said blades resembles a non-cavitating and non-venting hydrofoil.

12. A propulsion device in a liquid comprising, a. a motor driven propeller shaft having a central axis concentric to said propeller shaft and having a direction of rotation around said central axis, said propeller shaft being attached to a propeller comprising a hub attached to said propeller shaft, and at least one blade attached to said hub, and said propulsion device configured such that in operation said propeller rotates, and said propeller rotation propels said liquid in a propulsion direction that is substantially parallel to said central axis and is a downstream direction, said propulsion of said liquid producing a thrust on said propeller in substantially an inverse direction to said propulsion direction of said liquid, said inverse direction being an upstream direction, and whereby said at least one blade moves in a helical path relative to said liquid, and b. said at least one blade comprising a base attached to said hub, and a tip being substantially at a maximum radius of said propeller, and a leading edge and a trailing edge, with said leading edge and said trailing edge attached to said hub and said tip, a front side facing toward said upstream direction and a rear side facing toward said downstream direction, and said front side and said rear side converging at said leading edge and said trailing edge respectively, and c. said at least one blade having chords, each said chord being a distance measured between said leading edge and said trailing edge along an arc that is equidistant from said central axis, and d. said at least one blade having a predetermined angle of attack on said liquid, said angle of attack being defined by an angle between said chords and said helical path, said angle of attack configured such that in operation, at a predetermined speed of said rotation, said leading edge penetrates and separates said liquid creating a high pressure in said liquid contiguous to said rear side of said at least one blade and a low pressure in said liquid contiguous to said front side of said at least one blade, whereby creating high pressure and low pressure surfaces on said at least one blade respectively, and whereby propelling said liquid in said propulsion direction, and e. a gas passage connecting a gas from a gas source to at least one gas port in close proximity to said leading edge of said low pressure surface, said gas having a pressure and said gas pressure being substantially higher than said low pressure in said liquid contiguous to said front side, such that in operation said gas can be released from said at least one gas port and be drawn onto said low pressure surface to form a void in said liquid contiguous to said low pressure surface and said void being able to extend in said downstream direction relative to said trailing edge, such that in operation, said low pressure surface is essentially a dry surface, and said high pressure surface is essentially a wetted surface, whereby said at least one blade is in a vented state, and whereby said vented state prevents cavitation of said at least one blade.

13. The device of claim 12 wherein said at least one gas port is situated directly upstream of said leading edge.

14. The device of claim 12 where said at least one gas port is situated in said low pressure surface directly downstream of said leading edge and connected to said gas source by said gas passage passing through said at least one blade.

15. The device of claim 12 further including a deflector flange at a predetermined section of said leading edge on said low pressure surface of said at least one blade, said deflector flange configured such that in operation, said deflector flange deflects said liquid away from said low pressure surface, whereby substantially reducing said predetermined speed of said rotation and said predetermined angle of attack required to provide said low pressure to draw in said gas from said at least one gas port to create said void in said liquid contiguous to said low pressure surface.

16. The device of claim 12 where said leading edge and said trailing edge are substantially longer than any of said cords.

17. The device of claim 12 further comprising means for adjusting said angle of attack of said at least one blade during operation.

18. The device of claim 12 being configured to operate within a tube.

19. The device of claim 12 where said cord at said tip is substantially greater than said cord at said base of said at least one blade.

* * * * *